United States Patent [19]

Goodrich et al.

[11] 4,004,631

[45] Jan. 25, 1977

[54] ELECTROMAGNETIC CASTING APPARATUS

[75] Inventors: David G. Goodrich, San Ramon; Ludwig John, Pleasanton, both of Calif.

[73] Assignee: Kaiser Aluminum & Chemical Corporation, Oakland, Calif.

[22] Filed: July 28, 1975

[21] Appl. No.: 599,744

[52] U.S. Cl. ..... 164/250

[51] Int. Cl.[2] ..... B22D 27/02

[58] Field of Search ..... 164/250, 251, 147, 146, 164/49

[56] References Cited

UNITED STATES PATENTS

| | | | |
|---|---|---|---|
| 3,702,155 | 11/1972 | Getselev | 164/250 UX |
| 3,741,280 | 6/1973 | Kozhevrov et al. | 164/250 |
| 3,773,101 | 11/1973 | Getselev | 164/251 |

*Primary Examiner*—Richard B. Lazarus
*Assistant Examiner*—John E. Roethel
*Attorney, Agent, or Firm*—Paul E. Calrow; Edward J. Lynch

[57] ABSTRACT

The invention relates to an electromagnetic casting apparatus having an annular coolant jacket wherein a ring-type electromagnetic inductor is employed as the innermost wall of the coolant jacket and the inductor is preferably provided with conduits to direct coolant from within the coolant jacket onto the metal being cast.

8 Claims, 4 Drawing Figures

ELECTROMAGNETIC CASTING APPARATUS

BACKGROUND OF THE INVENTION

This invention relates to an improvement in the continuous or semicontinuous casting of molten metal in an alternating current electromagnetic field to control the shape of the solidifying metal.

Ingots or billets which have been continuously or semi-continuously D.C. cast in conventional open-ended tubular molds are usually characterized by a surface roughened by defects, such as cold folds, liquations, hot tears and the like, which result primarily from contact between the mold and the solidifying embryonic metallic shell. Moreover, conventionally D.C. cast ingot and billet are also characterized by a surface zone which has considerable alloy segregation due to the initial cooling of the molten surface from contact with the mold, reheating of the metal surface after mold contact and then final cooling of the metal surface from the direct application of coolant. Subsequent fabrication steps, such as rolling, extruding, forging and the like, usually require the scalping of the ingot or billet prior to working to remove both the surface defects and the alloy impoverished zone adjacent the surface.

In electromagnetic casting, there is no contact with the embryonic metallic shell during solidification and due to this lack of contact, most surface defects are eliminated. Moreover, due to the lack of contact between the embryonic metal surface and a mold surface, there is usually no cooling, heating, then cooling of the metal surface which causes the formation of the alloy impoverished zone adjacent the surface. As a result, electromagnetically cast metal has an essentially homogeneous composition throughout the entire cross section thereof. Because the electromagnetically cast metal surface is smooth and has essentially no alloy constituent segregation, there is usually no need to scalp the electromagnetically cast material prior to fabrication. Additionally, due to the homogeneous composition and structure, there is considerably less edge cracking during hot rolling so that less edge trimming is necessary after rolling.

The electromagnetic field utilized in electromagnetic casting generates forces normal to the surface of the molten metal which control the shape of the molten metal during solidification. The field is produced by a ring-type inductor and when molten metal is fed to the inner peripheral area of the inductor, the interaction of the electromagnetic field with the eddy currents induced in the molten metal generates the electromagnetic forces which control the cross-sectional shape of the solidifying metal to the same general shape as the inductor. The radial force components generated by the electromagnetic field prevent any significant lateral movement of molten metal and thus no contact between the molten metal and the inductor occurs. With the application of coolant, the molten metal solidifies in the shape induced by the electromagnetic field. A high frequency electrical power source (e.g., 500–3000 cps) is usually employed in electromagnetic casting because at the high frequencies, the induced currents in the molten metal concentrate at the surface of the molten metal (commonly termed "skin effect") so there is very little turbulence in the molten metal.

The principles of electromagnetic casting are basically the same principles as those of electromagnetic levitation and zone refining, which are well described in the literature, e.g., see U.S. Pat. No. 2,686,864 (Wroughton et al) and the Journal of Metals, Vol. 4, pp 1286–1288 (1952). Getselev and his coworkers developed a practical electromagnetic apparatus for casting large commercial-sized ingots and billet based on these principles. Their design was first described in U.S.S.R. Inventor Certificate No. 233,186 (issued Dec. 18, 1968) and various modifications of the basic design are shown in U.S. Pat. Nos. 3,467,166; 3,605,865; 3,646,988; 3,702,155 and 3,773,101. For additional descriptions of the electromagnetic casting unit and process developed by Getselev et al, see Tsvetnye Met, August 1970, Vol. 43, (8), 64–65 and the Journal of Metals, Vol. 8, October 1971, pp. 38–39. See also U.S. Pat. No. 3,741,280.

Two different ring-type electromagnetic inductors have been described by Getselev and both usually require continual contact with coolant to control the temperature of the inductor. The first type is a hollow inductor internally cooled with a suitable fluid such as water. This type of inductor is difficult and expensive to fabricate and maintain, but nonetheless, it is an effective inductor when properly used. The other type inductor described by Getselev involves a solid inductor disposed within a coolant chamber of the water jacket, preferably in an area where there is a high water velocity to maintain appropriate heat transfer rates. However, this latter method reduces the electromagnetic efficiency due to the increased distance required between the inductor and the molten metal surfaces being controlled. Moreover, the nonmetallic members adjacent the metal being cast may be damaged by metal spills and the like and are also subject to thermal and mechanical distortion.

The radial component of the electromagnetic pressure against the molten metal column generally must be equal to the hydrostatic pressure of the molten metal being shaped. To compensate for the gradually lower hydrostatic pressure of the molten metal column progressing toward the upper portions thereof, a shield or screen is preferably positioned between the inductor and the top of the molten metal column to attenuate the electromagnetic field generated by the inductor and thereby gradually reduce the radial forces acting on the molten metal toward the top of the column (see U.S. Pat. No. 3,467,166 — Getselev et al). By this means, the molten metal surface can be maintained relatively straight in the vertical direction and the curvature of the top corners of the molten metal column can be maintained relatively small. Without the electromagnetic screen, the curvature radius of the upper corner or corners of the shaped molten metal can become so large that the curved top surface of the molten metal column intersects with the solidification zone causing severe surface waves and other defects. However, the placement of the electromagnetic shield between the inductor and the molten metal surface being controlled requires positioning the inductor farther away from the molten metal surface, which increases electrical power requirements. Additionally, the electromagnetic shield can consume up to 30% or more of the electrical power supplied to the inductor.

Getselev found that large masses of metallic materials are not desired in the immediate vicinity of the electromagnetic inductor because a large metallic mass interferes with the electromagnetic field employed to control the shape of the solidifying ingot and can consume large amounts of energy. For this reason, the water jacket and other components, except for the electromagnetic shield and inductor, are formed of nonmetallic, non-conducting materials, such as micarta, epoxy-bonded fiberglass and the like. However, the nonmetallic, nonconductive members of the water jacket were found to be subject to mechanical and thermal distortions which interfered with the even application of coolant onto the solidifying ingot. Uneven coolant application detrimentally affects surface cooling and severely interferes with the uniform solidification patterns in the metal necessary for high quality ingot or billet. As a result, the nonmetallic parts of the coolant distribution system normally need frequent maintenance or replacement to maintain the appropriate distribution of coolant around the solidifying metal.

It is against the background that the present invention was developed.

DESCRIPTION OF THE INVENTION

Figure 1:
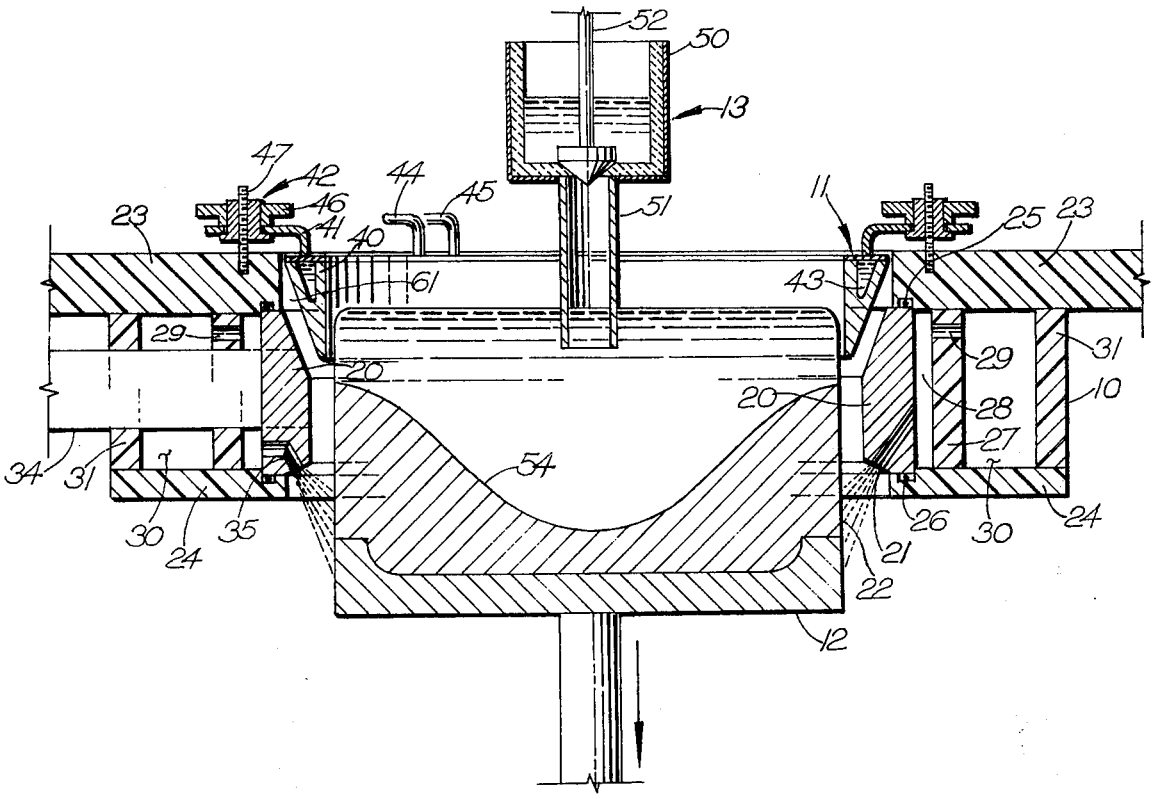
FIGS. 1 and 2 are respectively an elevational view in section and a perspective view partially in section of an embodiment of the invention.
Figure 2:
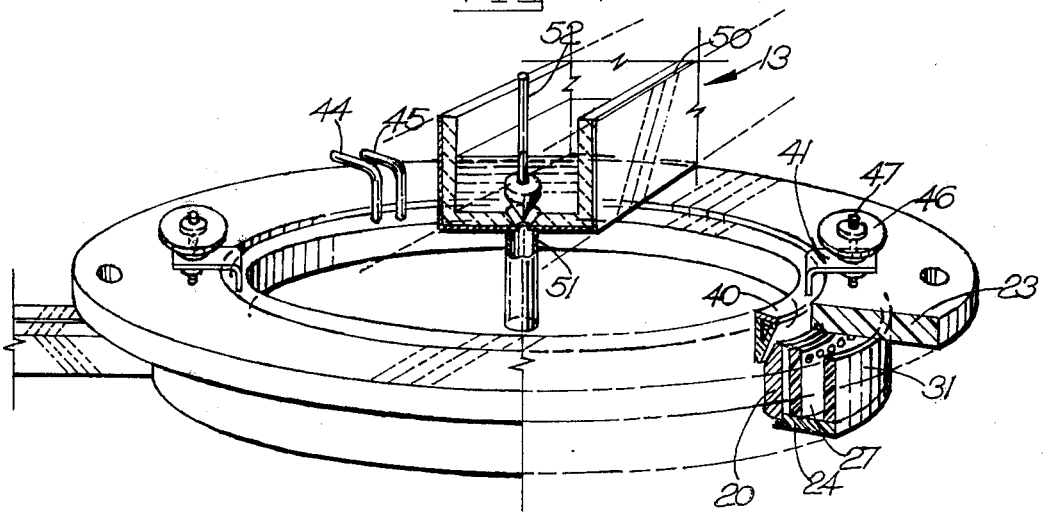

The invention generally relates to the electromagnetic casting of molten metal and in particular is directed to an improvement therein which reduces fabrication costs and electrical power requirements and also improves the shape control of the molten metal.

The invention is generally directed to an improvement in an electromagnetic casting device comprising a ring-type electromagnetic inductor (A.C.) to control the shape of molten metal disposed within the inner peripheral area of the inductor and a coolant source disposed concentrically about the column of metal for the application of coolant onto the surface thereof to effect solidification.

In accordance with the invention, an annular coolant jacket is provided as the coolant source and the ring-type inductor is disposed as the inner wall of the coolant jacket. Preferably, the inductor is provided with a plurality of coolant-carrying passageways in the lower portion thereof to apply coolant from a chamber within the annular coolant jacket onto the metal surface to cool and thus solidify the column of molten metal. Using the inductor as the inner wall of the coolant jacket allows for the close placement of the inductor to the molten metal surface being controlled and also eliminates the use of nonmetallic members, which are subject to distortion and degradation, immediately adjacent to molten metal.

Positioning the inductor much closer to the molten metal being shaped by the inductor lowers considerably the electrical power requirements for electromagnetic casting and generally provides better shape control, particularly when the upper section of the inner inductor surface is inclined away from the axis of the apparatus as described and claimed in the inventor's copending application Ser. No. 599,745 filed concurrently herewith and having the same assignee as the instant application. Maintenance costs with respect to the water distribution system of the invention are significantly reduced because essentially no mechanical and thermal distortion of the metallic inductor occurs. An additional advantage in the use of the inductor as the innermost wall of the water jacket is the fact that the inductor is continually bathed by high velocity coolant so there is no need for complex internal cooling of the inductor.

Reference is made to the drawings which illustrate the invention in more detail. The electromagnetic casting apparatus generally comprises an annular coolant jacket-inductor assembly 10, an optional electromagnetic shield assembly 11, a bottom block assembly 12 and a molten metal feeding assembly 13.

The coolant jacket-inductor assembly 10 comprises an electromagnetic inductor 20 as the innermost wall of the assembly 10 which is provided with a plurality of coolant-carrying passageways 21 for directing water or other coolant onto the surface of the solidifying ingot 22. The inductor 20 is fixed in a sealed relationship with the top member 23 and a bottom member 24 with sealing elements or gaskets 25 and 26 disposed between the surfaces. An upstanding baffle member or wall 27 is positioned on the bottom member 24 adjacent the outer surfaces of the inductor 20 so as to define a coolant chamber 28 with members 23 and 24. The wall 27 is provided with one or more coolant-carrying passegeways 29 to direct coolant to chamber 28 from chamber 30 defined by the baffle or wall member 27, members 23 and 24 and side member 31.

Coolant jacket members 23, 24, 27 and 31 are nonmetallic and nonconducting and generally may be formed of material, such as laminated sheet of epoxy-bonded fiberglass cloth, polyvinyl chloride, polyethylene and the like.

The upper surface 32 of electromagnetic inductor 20 is preferably inclined vertically away from the axis of the coolant jacket-inductor assembly 10 to reduce the electromagnetic forces on the upper portion of the molten metal column. The vertically inclined outer surface 33 of the electromagnetic shield 40 is generally parallel to surface 32 to allow the inductor 20 to be positioned much closer to the solidifying ingot than prior art designs. The angle of surface 32 with the vertical varies depending upon such factors as metal head and the like. Usually the desired angle is empirically determined and generally is between 20° and 60°.

Figure 3:
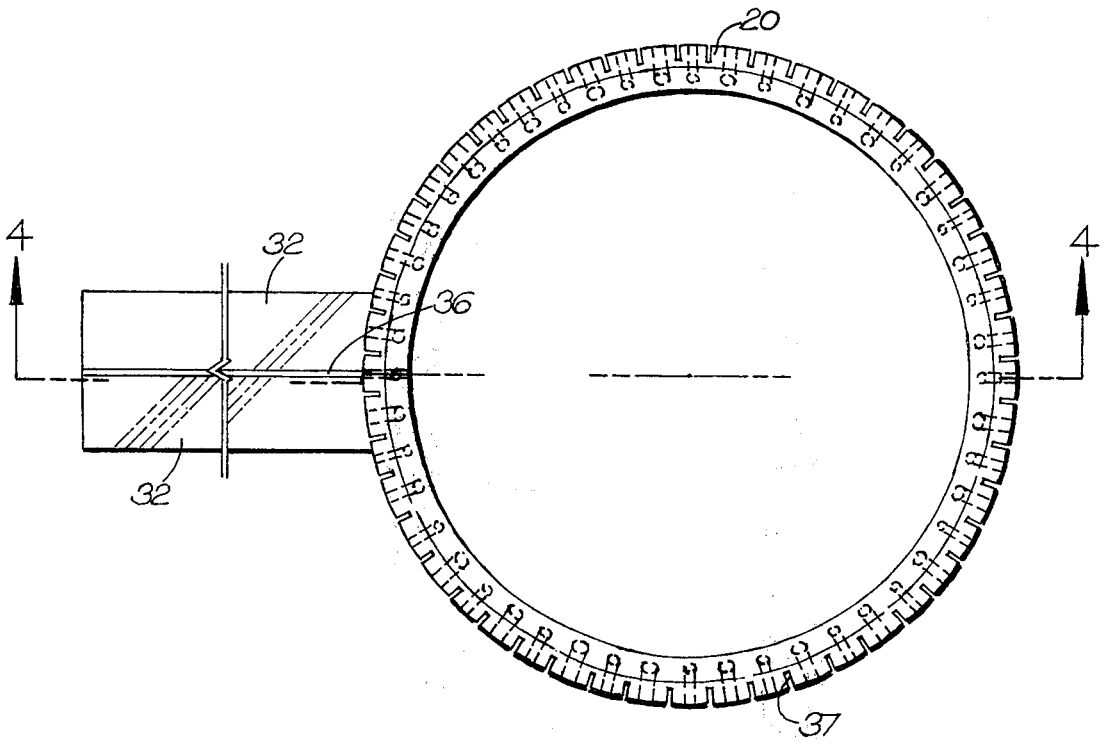
FIG. 3 is a bottom view of the inductor.
Figure 4:
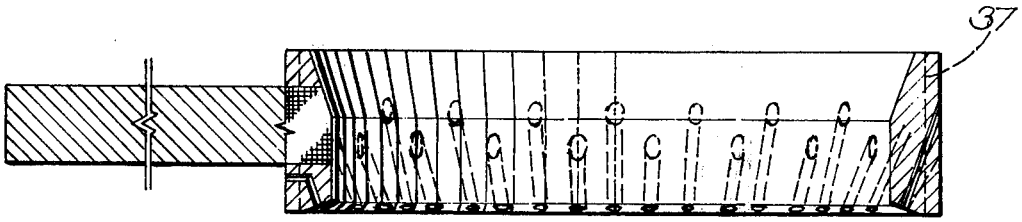
FIG. 4 is a sectional view taken along the line 4—4 in FIG. 3.

Inductor leads 34 are electrically connected to the outer surface of inductor 20 preferably with a highly conductive solder, such as a silver containing solder, between the mating surfaces. In the area of the inductor 20 where the electrical leads 34 are attached, the coolant passegeways 35 for directing coolant onto the emerging ingot are modified to accommodate for the connection. However, the discharge angle of the coolant through the conduits 35 should be the same as that provided by the other coolant passageways 21 so as to not detrimentally affect the cooling or solidification pattern in the ingot. The ends of the inductor 20 and the adjoining surfaces of the leads 34 are electrically insulated from one another by a sheet 36 of suitable nonconducting material, such as laminated sheet formed from silicon-bonded fiberglass cloth as shown in FIG. 3. To reduce the magnetic field generated outside the inductor 20, a plurality of grooves 37 can be milled into the outer surface of the inductor as shown in FIG. 3.

The inductor 20 may be formed from highly conductive material, such as 99.9+% electrolytic tough pitch copper, and is generally of the shape of the desired ingot cross-sectional shape. For safety reasons, the innermost surface of the inductor should be coated with a suitable nonconducting material, preferably refractory in nature, such as Sauereisen electrical resistor cement No. P-78 sold by the Sauereisen Company.

The electromagnetic shield assembly 11 disposed partially above the inductor 20 comprises an electromagnetic shield 40 formed of nonmagnetic metallic material having a relatively high resistivity such as stainless steel. The shield 40 is supported by a plurality of L-shaped support members 41 which are associated with height adjusting means 42. Preferably, a coolant chamber 43 is provided within the electromagnetic shield 40 which is supplied with coolant through conduits 44 and 45 in the top of the electromagnetic shield 40. The shield is raised or lowered by turning the handles 46 on the threaded posts 47 which are fixed in a suitable manner to upper member 23 of the coolant jacket assembly 10. The electromagnetic shield 40 allows for a much finer control of the molten metal shape. However, because of the geometry of the inductor with the inclined upper surface in accordance with the invention, the electromagnetic shield does not consume the amount of electrical power characterized by the prior art shields.

The molten metal feeding assembly 13 comprises a refractory lined feed trough 50 for directing molten metal from a furnace or other molten metal holding device (not shown) to the casting assembly. Molten metal flows from the trough 50 through refractory downspout 51 into the inner peripheral area of the inductor 20. The molten metal flowing through downspout 51 is restricted by metering element 52 to control the level of molten metal column within the electromagnetic field. Metering element 52 can be actuated in a suitable fashion, such as by a conventional float assembly (not shown) or another equivalent device. It is recognized that other means can be employed to feed molten metal to the casting assembly.

In the operation of the apparatus shown in FIG. 1, the bottom block 12 is raised into position beneath the electromagnetic shield 40. High frequency electrical power of about 500 to 3000 cps is supplied to the inductor 20 to generate the necessary electromagnetic field. Coolant (usually water) in chamber 30 flows through conduits 29 into chamber 28 and out conduits 21 and 35. Molten metal then is introduced to trough 50 wherein it flows through downspout 51 and onto the bottom block 12. The forces generated by the electromagnetic field immediately begin to shape the molten metal in the desired manner and then casting begins. Generally with light metals, such as aluminum and aluminum alloys, the solidification front in the metal being cast will be bell-shaped as shown in FIG. 1. The solidification front 54 on the molten metal surface should lie about the mid-point of the inductor as shown. Coolant application onto the metal surface is usually below the solidification front. Although the demarcation 56 between the molten and solidified metal is shown as being quite distinct in the drawings, in fact, there is a mushy zone of partially solidified metal about 0.1–2.0 inches thick between the solidified and molten metal. The thickness of the semi-solidified zone at a particular location within the ingot depends upon cooling rates and alloy composition.

Because of the close proximity of the inductor to the molten metal surface being controlled, the power requirements for field generation are considerably reduced by the invention. For example, in casting a 45 inch × 20 inch rolling ingot of 5182 aluminum alloy (Aluminum Association alloy designation) by means of the casting assembly of the invention, the required voltage was about 30 kilowatts with an inductor-to-molten metal distance of 0.5 inch (measured from the vertical surface of the inductor). Prior art electromagnetic casting units required about 100–120 kilowatts for the same sized ingot with an inductor-to-molten metal distance of about 1.0 inch.

The electromagnetic casting assembly described in detail herein is primarily designed for casting light metals, such as aluminum and alloys thereof, which have a relatively short molten metal sump during casting. However, when casting alloys having relatively low conductivities, such as steel, the length of the electromagnetic field along the axis of the assembly may be extended considerably over that shown and described herein for light metal products.

It is obvious that various modifications and improvements can be made to the invention without departing from the spirit thereof and the scope of the appended claims.

What is claimed is:

1. In an electromagnetic apparatus for the continuous or semicontinuous casting of metal ingots or billets, wherein a solid ring-type metallic electromagnetic inductor is provided to generate electromagnetic forces which control the shape of a column of molten metal disposed within the inner peripheral area of the inductor and wherein a coolant source is disposed around said metal column to direct coolant onto the surface of the metal so as to cause the solidification thereof, the improvement comprising an annular coolant jacket as said coolant source with the solid ring-type metallic electromagnetic inductor disposed immediately adjacent the column of molten metal as the inner wall of the annular coolant jacket with the inner peripheral area of the inductor exposed to the column of molten metal, the inductor thereby defining in part a coolant chamber within the coolant jacket so that the inductor is cooled by the coolant in the chamber.

2. The electromagnetic casting apparatus of claim 1 wherein the metallic inductor is provided with a plurality of coolant-carrying passageways to direct coolant from the coolant chamber within said coolant jacket onto the metal surface to cause metal solidification.

3. The apparatus of claim 1 provided with an annular electromagnetic shield to attenuate the electromagnetic forces in the upper portion of the molten metal.

4. The improvement of claim 1 wherein the inner surface of the upper portion of the inductor is inclined away from the axis of the apparatus in the vertical direction to generate an electromagnetic field which has a flux density which diminishes in intensity toward the top of the inductor and thereby maintains the vertical surface of the molten metal essentially straight.

5. The improvement of claim 1 wherein the coolant jacket is provided with an internal baffle which separates the chamber within the coolant jacket into two separate chambers, a smaller chamber between the baffle and the back surface of the inductor and a large chamber on the opposite side of the baffle, the baffle provided with at least one coolant-carrying passageway to allow coolant to flow from the larger chamber into the smaller chamber to thereby cool the inductor and thereafter onto the metal surface to cause solidification of molten metal.

6. The electromagnetic casting apparatus of claim 1 wherein essentially all of the coolant jacket members except for the inductor are formed of nonmetallic non-conducting materials.

7. The electromagnetic casting apparatus of claim 1 adapted to cast aluminum and aluminum alloys.

8. The electromagnetic casting apparatus of claim 1 wherein the inner peripheral area of the inductor which is exposed to the molten metal column is provided with a protective coating.

* * * * *